United States Patent [19]

Sugiyama

[11] Patent Number: 4,811,819

[45] Date of Patent: Mar. 14, 1989

[54] DEVICE FOR HORIZONTALLY MOVING AN APPARATUS WORKING AT A HIGH LOCATION

[75] Inventor: Yutaka Sugiyama, Tokyo, Japan

[73] Assignee: Nihon Biso Kabushiki Kaisha, Tokyo, Japan

[21] Appl. No.: 162,174

[22] Filed: Feb. 29, 1988

[30] Foreign Application Priority Data

Mar. 9, 1987 [JP] Japan ..... 62-53484

[51] Int. Cl.[4] ..... E04G 3/10; E04G 3/14

[52] U.S. Cl. ..... 182/37; 182/142; 182/138; 182/129

[58] Field of Search ..... 182/36, 37, 142, 143, 182/144, 129, 82, 47, 138

[56] References Cited

U.S. PATENT DOCUMENTS

| | | | |
|---|---|---|---|
| 447,898 | 3/1891 | Nygren | 182/37 |
| 538,615 | 4/1895 | Lindsay | 182/142 |
| 624,567 | 5/1899 | Stone | 182/37 |
| 636,264 | 11/1899 | Klinck | 182/37 |
| 2,178,956 | 11/1939 | Dyer | 182/142 |
| 2,203,113 | 6/1940 | Uecker | 182/129 |
| 2,645,531 | 7/1953 | Rector | 182/37 |
| 3,900,080 | 8/1975 | Rea | 182/36 |
| 3,908,792 | 9/1975 | Shortt | 182/142 |
| 4,538,705 | 9/1985 | Leivestad | 182/142 |
| 4,738,335 | 4/1988 | Ishii | 182/138 |

*Primary Examiner*—Reinaldo P. Machado

*Attorney, Agent, or Firm*—Hedman, Gibson, Costigan & Hoare

[57] ABSTRACT

A device for horizontally moving an apparatus such as a gondola working at a high location such as a wall surface of a building comprises a mounting frame fixedly provided on the upper end portion of a structure and having a vertically extending rotary shaft receiving portion, a rail supporting member having a rotary shaft received in the rotary shaft receiving portion and also having an arm extending substantially normally from the rotary shaft and including a rail supporting portion at the foremost end thereof, a horizontally extending rail disposed detachably on the rail supporting portion, a rail pivoting device associated with the rail supporting portion and the rail for pivoting the rail when the rotation shaft is rotated, and a trolley mounted on the rail for suspending the apparatus working at a high location. The rail can be provided only provisionally when required and not permanently fixed to the structure.

10 Claims, 6 Drawing Sheets

DEVICE FOR HORIZONTALLY MOVING AN APPARATUS WORKING AT A HIGH LOCATION

BACKGROUND OF THE INVENTION

This invention relates to a device for horizontally moving an apparatus or machine working at a high location such, for example, as a gondola. The device is intended to move such apparatus or machine not only vertically but also horizontally along a provisionally mounted horizontal rail.

For conducting work at a high location such as a construction or repair work on a structure at a high location, e.g., a building, ship, power plant, tank, chimney or bridge, safely and efficiently, apparatuses and machines such as gondolas and automatic working machines are increasingly used in lieu of the conventional method employing a scaffold.

When a gondola which is one of apparatuses used for conducting work at a high location is used for conducting a work on a building, for example, a pair of mounting frames are fixedly mounted to a parapet provided on the roof of the building and a gondola is hung from the mounting frames by means of a pair of wires suspended from these mounting frames, the gondola being moved up and down by operating a widing device mounted on the gondola.

The gondola is capable of performing work efficiently in the vertical direction of the building. It can however perform work in the horizontal direction of the building on an area outside of its width only within a range in which a workman can extend his arm. For performing work in the horizontal direction, therefore, the mounting frames for the gondola must be displaced horizontally along the parapet. For the displacement of the mounting frames, the gondola must be once lowered to the ground and be lifted to a desired location again. The number of times the mounting frames must be displaced on the parapet increases as the range of the work to be carried out horizontally increases with resulting drop in the working efficiency. The same is the case with other apparatuses and machines working at high locations.

For obviating such inconvenient displacement of the mounting frames, there is a prior art device according to which a running rail is permanently provided on the roof of a building for enabling a carrier for a gondola to run horizontally along the running rail and a gondola is suspended from the carrier. This device however necessitates the permanent provision of the running rail on the roof of the building and therefore is costly. Besides, an area on the roof is narrowed due to the provision of the running rail.

It is, therefore, an object of the invention to provide a device for horizontally moving an apparatus or machine working at a high location capable of horizontally moving such apparatus or machine with a safe and simple structure.

SUMMARY OF THE INVENTION

For achieving the above described object of the invention, the device for horizontally moving an appratus or machine working at a high location according to the invention is characterized in that it comprises a mounting frame fixedly provided on the upper end portion of a structure and having a vertically extending rotary shaft receiving portion at the foremost end portion thereof, a rail supporting member having a rotary shaft received rotatably in the rotation shaft receiving portion of the mounting frame and also having an arm extending substantially normally from said rotary shaft and including a rail supporting portion at the foremost end portion thereof, a horizontally extending rail disposed detachably on said rail supporting portion of said rail supporting member, rail pivoting means associated with said rail supporting portion and said rail for pivoting said rail when said rotary shaft of said rail supporting member is rotated, and a trolley mounted on said horizontally extending rail for suspending an apparatus working at a high location.

According to the invention, the rail supporting member can be rotated about a vertical axis of the rotary shaft received in the rotary shaft receiving portion of the mounting frame so that the rail supporting portion of the arm can take one position near to the structure and another position remote from the structure by rotating the rail supporting member. Therefore, by rotating the arm towards a workman working on the roof of the structure or the like place and mounting the rail on the rail supporting portion of the arm and then rotating the rail supporting member to a predtermined position away from the structure, the apparatus such as a gondola can be suspended from the rail via the trolley mounted on the rail so that the apparatus can be moved not only vertically but also horizontally.

Since the rail can be mounted on the rail supporting member at a position near to the workman, the mounting work can be performed safely. Besides, since the rail is mounted only provisionally and not permanently, the cost for providing a rail is remarkably reduced as compared with the conventional method of providing a permanent rail on the roof of a building. Besides, space availabe on the roof of a building need not be sacrificed for providing a permanent rail. Since the rail is a provisional one, a suitable rail can be readily selected in accordance with the type, dimensions etc. of the apparatus used and also with the type of structure on which the work is to be performed. Besides, the device can be readily assembled and decomposed as required.

In the case of using a gondola, the displacement of the mounting frames for the gondola for horizontally moving the gondola is obviated so that the work by the gondola can be performed with high efficiency.

In one aspect of the invention, the rail supporting member further comprises the auxiliary supporting portion for supporting an auxiliary member for work at a high location such as a support for a protective net or a swivel arm of lifting gear. By this arrangement, the mounting of the protective net or mounting of the lifting gear can be readily and safely achieved whereby efficiency of such work can be greatly increased.

Preferred embodiments of the invention will now be described with reference to the accompanying drawings.

BRIEF DESCRIPTION OF THE DRAWINGS

In the accompanying drawings,

FIGS. 1 through 6 are views showing an embodiment of the device according to the invention applied to a horizontally moving gondola in which, FIG. 1 is a schematic view showing a working range of the gondola;

FIG. 2 is a side view of the device;

FIG. 3 is a plan view of the device;

FIG. 4 is a plan view of a provisionally mounted horizontal rail;

FIG. 5 is a sectional view of a horizontally moving trolley; and

FIG. 6 is a front view of the device and the gondola:

FIGS. 7 and 8 are views showing another embodiment of the device according to the invention applied to a device for mounting a protective net in which FIG. 7 is a front view of the device; and FIG. 8 is a side view of the device.

DESCRIPTION OF PREFERRED EMBODIMENTS

Description will be made about a case where this invention has been applied to a gondola.

Figure 1:
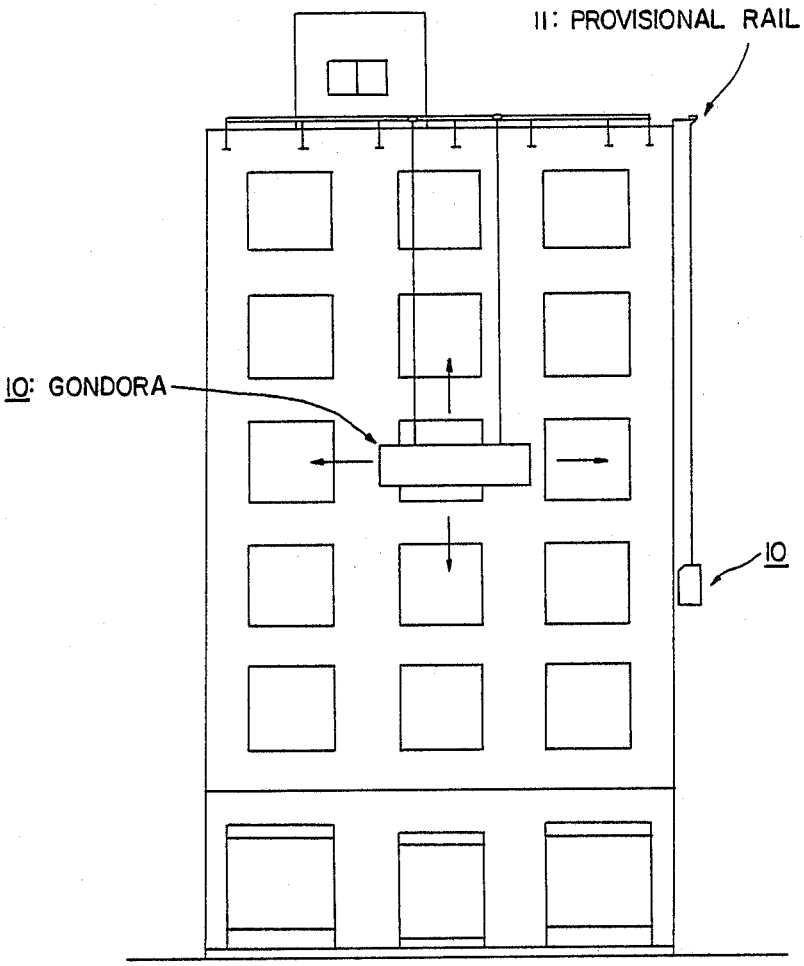

Referring first to FIG. 1, a gondola 10 can be moved not only vertically but also horizontally by means of a provisionally provided device 11 according to the invention. The gondola 10 is used for working on the wall of a structure, e.g., a building 1.

Figure 3:
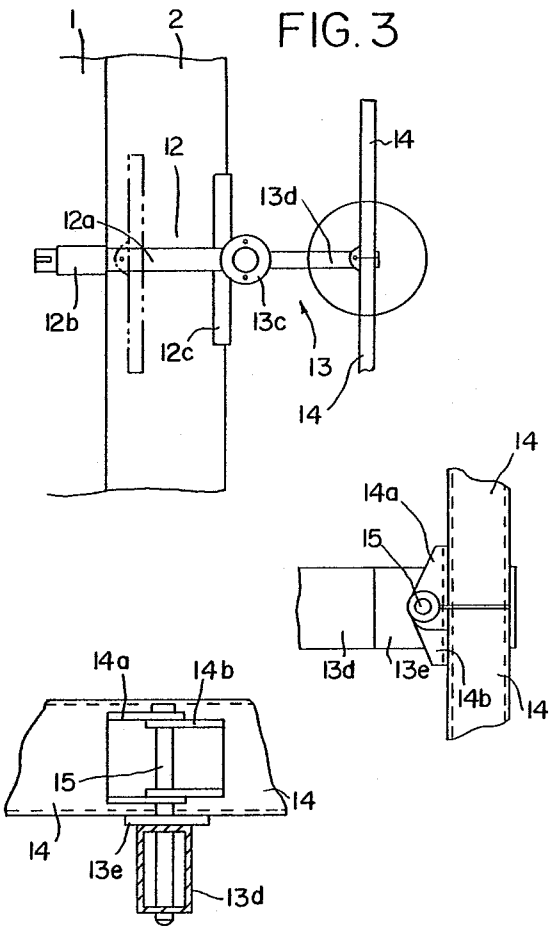
Figure 2:
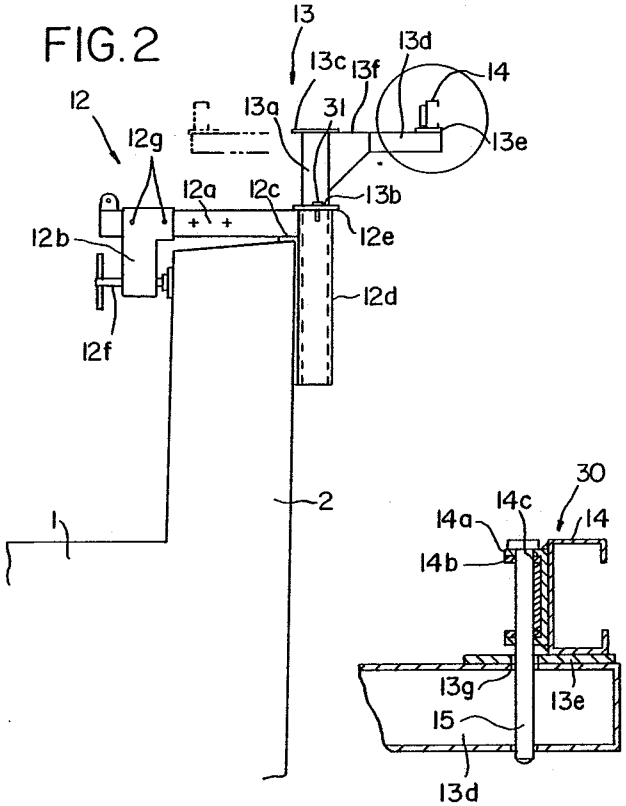

The provisionally provided device 11 comprises, as shown in FIGS. 2 and 3, a mounting frame 12 which is secured to a parapet 2 of the building 1 in such a manner that the mounting frame clamps the parapet 2. The mounting frame 12 has a horizontal arm 12*a* and a downwardly projecting slide arm 12*b* which is slidably mounted on the horizontal arm 12*a*. Positions of bolts 12*g* are adjusted according to the thickness of the parapet 2.

A corner plate 12*c* of an L-shaped section is welded at the lower surface of the foremost end portion of the horizontal arm 12*a* and a vertically extending cylindrical rotary shaft receiving portion 12*d* is also welded to the foremost end portion of the horizontal arm 12*a* in such a manner that this portion 12*d* opposes the slide arm 12*b* across the parapet 2. A flange 12*e* is secured rigidly to the upper end of the rotary shaft receiving portion 12*d*. A screw jack 12*f* is provided in the lower portion of the slide arm 12*b* for securing the mounting frame 12 by clamping the parapet 2.

A rail supporting member 13 is rotatably and fixably mounted on the mounting frame 12.

The rail supporting member 13 comprises a rotary shaft 13*a* which is fittingly received in the rotary shaft receiving portion 12*d* of the mounting frame 12 and therefore is rotatable about its vertical axis. A flange 13*b* is fixedly secured at the middle portion of the rotary shaft 13*a* in such a manner that the flange 13*b* abuts against the flange 12*e* of the mounting frame 12. An annular flange 13*c* is fixedly secured to the upper end of the rotary shaft 13*a*. This flange 13*c* is utilized for supporting an auxiliary member such as a member for mounting a protective net as will be described more in detail later.

An arm 13*f* having a rail supporting portion 13*d* at the foremost end portion thereof is welded at the base portion thereof to the upper end portion of the rotary shaft 13*a*. The arm 13*f* extends horizontally, i.e., substantially normally to the rotary shaft 13*a*. A reinforcing plate 13*e* is secured fixedly on the upper surface of the foremost end portion of the rail supporting portion 13*d* for mounting a horizontal rail 30 thereon. There is formed an opening 13*g* in the reinforcing plate 13*e* and the rail supporting portion 13*d* for receiving a vertical connecting pin 15 for connecting the horizontal rail 30 to the rail supporting portion 13*d*.

The provisionally mounted horizontal rail 30 consists of a plurality of rail components 14. Adjacent end portions of adjacent rail components 14 are supported on the reinforcing plate 13*e* of the rail supporting portion 13*d* and conncected to each other on this reinforcing plate 13*e*.

The rail component 14 is of a C-shaped cross section made of a channel steel with lips or like material. A bracket 14*a* of a C-shaped cross section is welded to the back surface of one end portion of the rail component 14 and a bracket 14*b* which is also of a C-shaped cross section but of a smaller height than the bracket 14*a* is welded to the back surface of the other end portion of the same rail component 14. Thus, rail components which are adjacent to each other are connected in such a manner that the bracket 14*b* of one rail component 14 is fitted in the bracket 14*a* of the other rail component 14 on the reinforcing plate 13*e* and the end surfaces of the adjacent rail components 14 are in abutting engagement with each other. The connecting pin 15 is inserted in openings 14*c* formed in the brackets 14*a* and 14*b* and the opening 13*g* of the reinforcing plate 13*e* and the rail supporting portion 13*d* so that rail components 14 are rotatably connected to the rail supporting portion 13*d* of the rail supporting member 13.

Accordingly, when the rail supporting member 13 is rotated about the vertical axis of the rotation shaft 13*a* towards or away from the building 1, the respective rail components 14 constituting the straight rail 30 slide simultaneously on the reinforcing plate 13*e* with their end surfaces kept in abutting engagement with each other.

Figure 4:
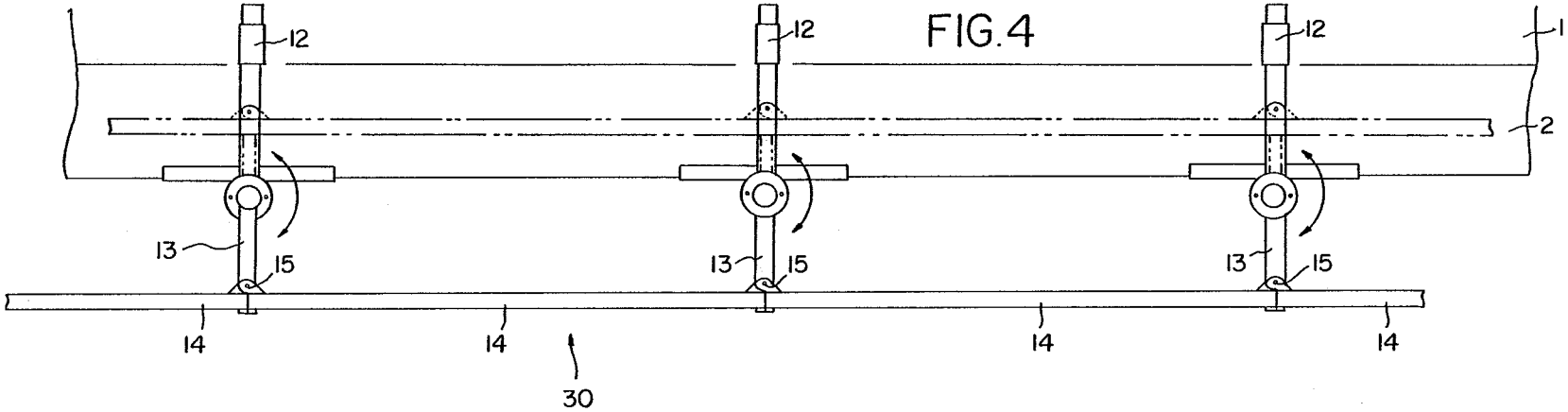

As shown in FIG. 4, the rail components 14 of the horizontal rail 30 are connected to respective adjacent rail components with the aid of the mounting frames 12 and rail supporting members 13 mounted to the parapet 2 with a distance corresponding to the length of each rail component 14 and are provided by a required length along the parapet 2.

For connecting the rail components 14 together, the rail supporting members 13 are rotated towards the building 1 to positions as shown by a chain-and-dot line in FIG. 4. In this position in which the rail supporting portions 13*d* are located above the parapet 2, the workman can connect the rail components 14 very safely without the risk of stretching his body over the parapet 2 towards the outside of the building 1.

Figure 5:
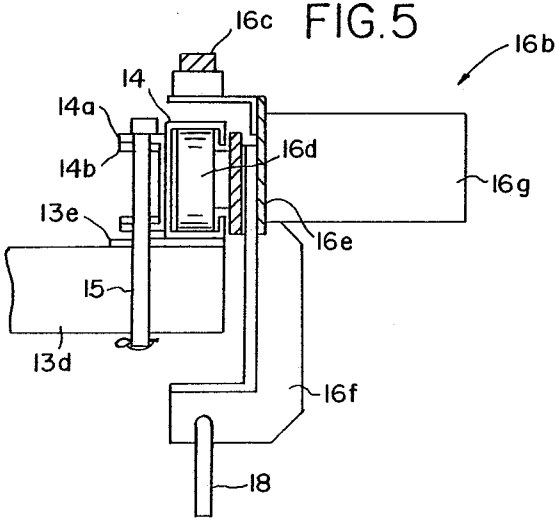
Figure 6:
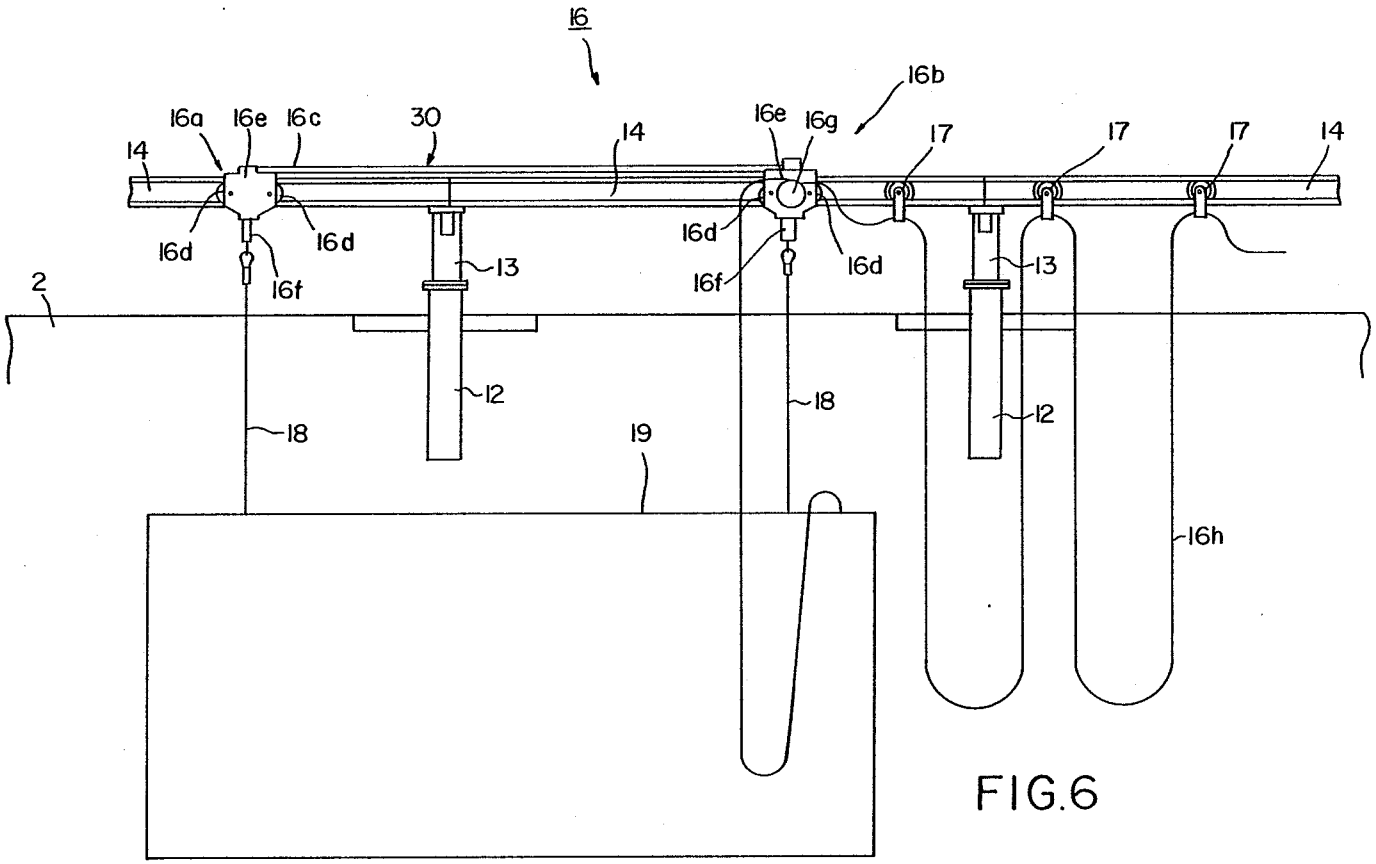

The trolley 16 which is adapted to run horizontally along the rail 30 consists of a driven trolley 16*a* and a drive trolley 16*b* as shown in FIGS. 5 and 6. The two trolleys 16*a* and 16*b* are connected to each other by means of a connecting rod 16*c* so that they always run together.

Each of the driven trolley 16*a* and the drive trolley 16*b* comprises two rollers 16*d* adapted to roll along the rail 30 and mounted to a frame 16*e* and a hook 16*f* secured to the frame 16*e* for suspending the gondola 19.

A motor 16*g* is coupled through a reduction gear (not shown) to one of the rollers 16*d* of the drive trolley 16*b*. A power cable 16*h* is hung through roller hangers 17 which are adapted to move horizontally within the rail 30. Gondola suspending wires 18 are tied to the hooks 16*f* of the trolley 16 for suspending the gondola 19. The gondola 19 can be moved up and down by operating a winding device 20 (FIGS. 7 and 8) mounted in the gondola 19. Accordingly, the gondola 19 can be moved horizontally by driving the trolley 16 as well as vertically by operating the winding device 20.

For setting the device according to the invention, the mounting frames 12 of necessary number are mounted to the parapet 2 by turning the screw jacks 12*f*. Then the rotary shaft 13*a* of each rail supporting member 13 is inserted into the rotary shaft receiving portion 12*d* of each corresponding mounting frame 12. The rail supporting portion 13*d* is located over the parapet 2 or the roof of the building 1.

Nextly, the adjacent end portions of the respective adjacent rail components 14 are positioned on the rail supporting members 13 and the connecting pin 15 are inserted into the openings 14*c* of the brackets 14*a* and 14*b* and the openings 13*g* of the rail supporting portions 13*d* to connect the rail components 14 slidably on the rail supporting members 13.

After connecting the rail components 14 together over a range required for the work on the wall of the building 1, the driven trolley 16*a* and the drive trolley 16*b* of the trolley 16 are mounted in the rail components 14 and these trolleys 16*a* and 16*b* are connected to each other with the connecting rod 16*c*. The upper end portion of each gondola suspending wire 18 is tied to the hook 16*f*. Then, the rail supporting members 13 are simultaneousl rotated away from the building 1 to position the horizontal rail 30 at a predetermined location away from the parapet 2. Then the rail supporting members 13 are fixedly secured to the mounting frames 12 by securing the flanges 13*b* of the rail supporting members 13 to the flanges 12*e* of the mounting frames 12 by means of bolts 31 (FIG. 2) or like means.

Then the gondola suspending wires 18 are tied to the winding device 20 of the gondola 19 disposed on the ground whereby preparation for the work on the wall of the building 1 by the gondola 19 is completed.

Thereafter, the gondola 19 is moved up and down by operating the winding device 20 and moved horizontally by driving the motor 16*g* of the trolley 16 whereby the work on the wall of the building 1 is performed by shifting the gondola 19 to a desired position on the wall.

Figure 8:
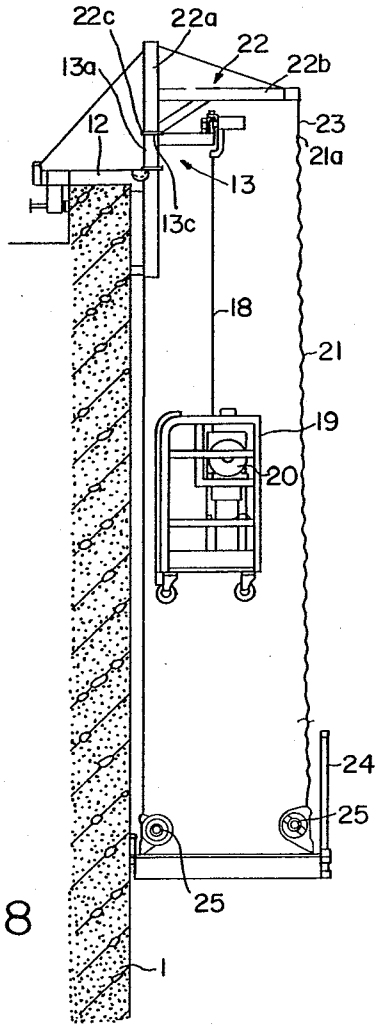
Figure 7:
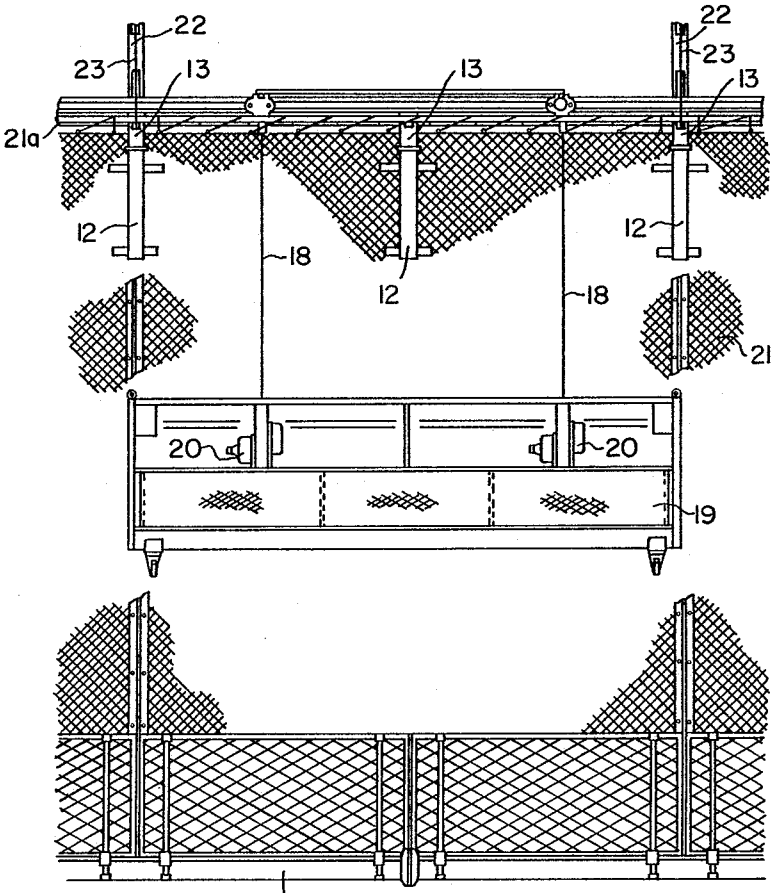

Another embodiment of the invention will now be described with reference to FIGS. 7 and 8.

When the gondola 19 is used for work on the wall of the building 1, a protective net 1 is often used for preventing scattering or falling of dusts. The device of the invention can be utilized for mounting a support member 22 for suspending the protective net 21 which constitutes an auxiliary member. In this embodiment, the rotary shaft 13*a* of the rail supporting member 13 is hollow at least in the upper portion thereof and the support member 22 comprises a vertical shaft 22*a* which is fitted in the hollow portion of the rotary shaft 13*a* and a horizontal arm 22*b* extending from the shaft 22*a*. A wire 23 is hung from the foremost end portion of the arm 22*b* to suspend a horizontal pipe 21*a* for suspending the protective net 21.

A flange 22*c* which is in abutting engagement with the flange 13*c* of the rotary shaft 13*a* is secured fixedly to the middle portion of the shaft 22*a* so that the arm 22*b* which can rotate about the vertical axis of the shaft 22*a* can be fixed. The length of the arm 22*b* is so set that a distance which will permit the vertical and horizontal movements of the gondola 19 will be secured. The foremost end portion of the arm 22*b* is so shaped that the wire 23 can slide freely.

In providing the protective net 21, the support member 22 is mounted to the rail supporting member 13, the wire 23 is provided over the foremost end portion of the arm 22*b* and the top of the shaft 22*a* with one end of the wire 23 being tied to the rear end portion of the mounting frame 12 and the other end of the wire 23 being tied to the pipe 21*a*. The protective net 21 is suspended from the pipe 21*a* and thus covers an area of the wall between the pipe 21*a* and a platform 24. By moving the platform 24 up and down by operating a winding device 25 provided in the platform 24, the area of the protective net 21 can be changed.

By mounting the support member 22 for suspending the protective net 21 to the rail support member 13 as the auxiliary member for the work of the gondola 19, the provision of the protective net is greatly simplified since a device such as a screw jack for fixing the arm 22*b* is unnecessary.

Figure 9:
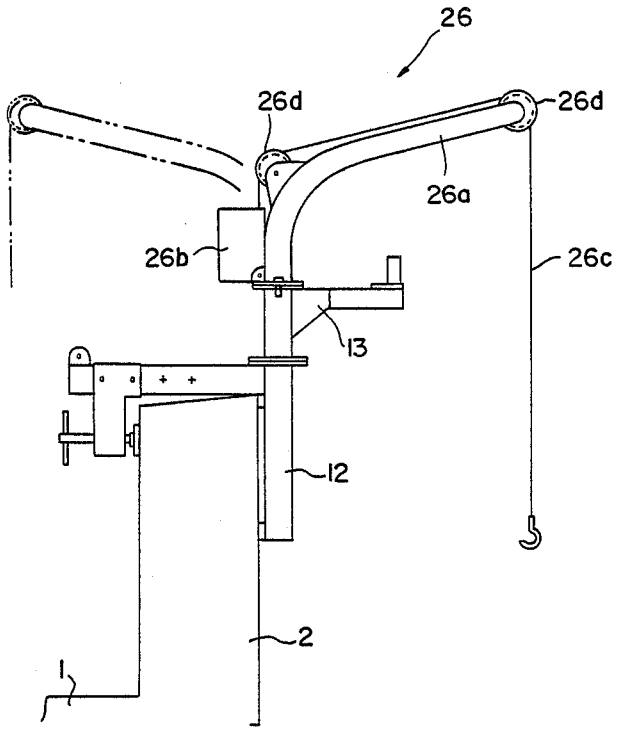
FIG. 9 is a side view showing still another embodiment of the device according to the invention applied to lifting gear.

A still another embodiment of the invention will be described with reference to FIG. 9.

In this embodiment, a swivel arm 26*a* of lifting gear 26 constitutes the auxiliary member for the gondola 19. The swivel arm 26*a* is rotatably inserted in the rotary shaft 13*a* of the rail supporting member 13. A wire 26*c* secured to a winding device 26*b* is hung through wheels 26*d* provided at the middle portion and and the foremost end portion of the swivel arm 26*a*. By this arrangement, carrying of materials and instruments from the ground to the roof of the building 1 can be facilitated and this is particularly useful when a lift of the building 1 cannot be used for carrying these materials and instruments for some reason. Besides, the lifting gear 26 can be readily shifted from one place to another by simply moving the swivel arm 26*a* which can be effected by attaching and detaching the swivel arm to and from the rotary shaft 13*a*.

In the above described embodiments, the support member for the protective net and the swivel arm of the lifting gear have been described as the auxiliary members. The auxiliary member however is not limited to these but may be any other members which are necessary for the work on the wall.

The apparatus working at a high location to which the invention can be applied is not limited to gondolas on which a self elevating and lowering device is provided but the invention is applicable to other various apparatus and machines such as a working platform in which a self elevating and lowering device is provided in the horizontally moving trolley or an automatic work machine.

What is claimed is:

1. A device for horizontally moving an apparatus working at a high location comprising:

a mounting frame fixedly provided on the upper end portion of a structure and having a vertically extending rotary shaft receiving portion at the foremost end portion thereof;

a rail supporting member having a rotary shaft received rotatably in the rotary shaft receiving portion of the mounting frame and also having an arm extending substantially normally from said rotary shaft and including a rail supporting portion at the foremost end portion thereof;

a horizontally extending rail disposed detachably on said rail supporting portion of said rail supporting member;

rail pivoting means associated with said rail supporting portion and said rail for pivoting said rail when said rotary shaft of said rail supporting member is rotated; and a trolley mounted on said horizontally extending rail for suspending the apparatus working at a high location.

2. A device as defined in claim 1 wherein said rail supporting portion of said rail supporting member supports said rail at adjacent end portions of adjacent rail components and said rail pivoting means comprises members attached to said adjacent end portions of said adjacent rail components and formed with openings and a pivot pin extending through said openings of said members and said rail supporting portion.

3. A device as defined in claim 1 wherein said apparatus is a gondola which can be moved vertically along a wall portion of the structure.

4. A device as defined in claim 1 wherein said apparatus is an automatic working machine.

5. A device as defined in claim 1 wherein said rail supporting member further comprises an auxiliary supporting portion for supporting an auxiliary member for work at a high location.

6. A device as defined in claim 5 wherein said rail supporting member supports said rail at adjacent end portions of adjacent rail components and said pivoting means comprises members attached to said adjacent end portions of said adjacent rail components and formed with openings and a pivot pin extending through said openings of said members and said rail supporting portion.

7. A device as defined in claim 5 wherein said auxiliary member is a support member for suspending a protective net for the structure.

8. A device as defined in claim 5 wherein said auxiliary member is a swivel arm of lifting gear.

9. A device as defined in claim 5 wherein said apparatus is a gondola which can be moved vertically along a wall portion of the structure.

10. A device as defined in claim 5 wherein said apparatus is an automatic working machine.

* * * * *